US007777465B2

(12) United States Patent
Chen et al.

(10) Patent No.: US 7,777,465 B2
(45) Date of Patent: Aug. 17, 2010

(54) OUTPUT TRANSIENT RESPONSIVE VOLTAGE REGULATOR CONTROLLING APPARATUS AND METHOD

(75) Inventors: Chung-Kuang Chen, Hsin-Chu (TW); Chun-Shiung Hung, Hsin-Chu (TW); Yi-Te Shih, Hsin-Chu (TW)

(73) Assignee: Macronix International Co. Ltd, Hsin-Chu (TW)

( * ) Notice: Subject to any disclaimer, the term of this patent is extended or adjusted under 35 U.S.C. 154(b) by 403 days.

(21) Appl. No.: 11/940,368

(22) Filed: Nov. 15, 2007

(65) Prior Publication Data

US 2009/0128115 A1 May 21, 2009

(51) Int. Cl.
*G05F 1/575* (2006.01)

(52) U.S. Cl. ..... 323/280

(58) Field of Classification Search ..... 323/273, 323/280

See application file for complete search history.

(56) References Cited

U.S. PATENT DOCUMENTS 6,229,289 B1 * 5/2001 Piovaccari et al. ..... 323/268
6,703,815 B2 * 3/2004 Biagi ..... 323/280
2009/0128115 A1 * 5/2009 Chen et al. ..... 323/284

* cited by examiner

*Primary Examiner*—Jeffrey L Sterrett
(74) *Attorney, Agent, or Firm*—Volpe and Koenig, P.C.

(57) ABSTRACT

A controlling method of a voltage regulator is provided. The voltage regulator at least includes a differential circuit and a pump high-voltage circuit which has a bias path, an output transistor and an output terminal. The controlling method includes steps of: providing at least a pre-charge path to the pump high-voltage circuit, closing the bias path and charging the output terminal with the pre-charge path when the output terminal is transient, detecting an output level of the output terminal, and closing the pre-charge path and open the bias path to bias the output transistor when the output level reaches a predetermined value.

19 Claims, 4 Drawing Sheets

OUTPUT TRANSIENT RESPONSIVE VOLTAGE REGULATOR CONTROLLING APPARATUS AND METHOD

FIELD OF THE INVENTION

The present invention relates to a voltage regulator and controlling method thereof, and more particularly to a high speed and low power voltage regulator for memory.

BACKGROUND OF THE INVENTION

Please refer to FIG. 1, which is a circuit diagram showing a conventional voltage regulator according to the prior art. In FIG. 1, the voltage regulator includes a differential circuit 11 and a pump high-voltage circuit 12. The differential circuit 11 includes a first stage circuit and a second stage circuit. The pump high-voltage circuit 12 includes a third stage circuit and a fourth stage circuit. The pump high-voltage circuit 12 is further electrically connected to an output stage circuit.

In the first stage circuit, the respective sources of the PMOS transistors P1 and P2 are electrically connected to a high voltage source Vdd. The respective gates of the PMOS transistors P1 and P2 are electrically connected to each other. The gate of the PMOS transistor P2 is electrically connected to the drain thereof. The drain of the NMOS transistor N1 is electrically connected to the drain of the PMOS transistor P1. The gate of the NMOS transistor N1 is to receive a voltage reference signal V_Reference. The drain of the NMOS transistor N2 is electrically connected to the drain of the PMOS transistor P2. The gate of the NMOS transistor N2 is to receive a feedback signal fb. The respective sources of the NMOS transistors N1 and N2 are electrically connected to the drain of the NMOS transistor N3. The gate of the NMOS transistor N3 is to receive a voltage bias signal V_bias. The source of the NMOS transistor N3 is electrically connected to a low voltage source Vss.

In the second stage circuit, the source of the PMOS transistor P3 is electrically connected to the high voltage source Vdd. The gate of the PMOS transistor P3 is electrically connected to the drain of the NMOS transistor N1. The drain of the PMOS transistor P3 is electrically connected to the drain of the NMOS transistor N4. The gate of the NMOS transistor N4 is electrically connected to the drain thereof. The source of the NMOS transistor N4 is electrically connected to the low voltage source Vss.

In the third stage circuit, the respective sources of the PMOS transistors P4 and P5 are electrically connected to a pump voltage source Pump HV. The respective gates of the PMOS transistors P4 and P5 are electrically connected to each other. The gate of the PMOS transistor P4 is electrically connected to the drain thereof. The drain of the NMOS transistor N5 is electrically connected to the drain of the PMOS transistor P4. The gate of the NMOS transistor N5 is electrically connected to the gate of the NMOS transistor N4. The source of the NMOS transistor N5 is electrically connected to the low voltage source Vss.

In the fourth stage circuit, the drain of the PMOS transistor P5 is electrically connected to electrically series-connected resistors R1 and R2. Another end of the resistor R2 is electrically connected to the low voltage source Vss.

The output stage circuit includes a capacitance load Cload. One end of the capacitance load Cload is electrically connected to a node between the drain of the PMOS transistor P5 and the resistor R1 to be the output terminal output, and another end of the capacitance load Cload is electrically connected to the low voltage source Vss.

Please refer to FIG. 2, which is a graph showing the output terminal voltage of the voltage regulator and the currents of the PMOS transistors P4 and P5 according to FIG. 1. When the capacitance load Cload is charged, the voltage level of the output terminal output is still low. The feedback signal fb is then raised to be close to the voltage reference signal V_Reference. The voltage of the node A is low, and the voltage of the node B rises from a low point. The voltage of the node B being at the high point will cause the voltage pbias of the node C to go low, and the current I2 of the PMOS transistor P5 is thus increased.

Besides, the current I1 of the PMOS transistor P4 is increased since the voltage pbias of the node C is low. The currents I1 and I2 are both provided by the pump voltage source Pump HV. For the increase of the currents I1 and I2 leads to the complex design and the poor current efficiency of the pump voltage source.

SUMMARY OF THE INVENTION

It is therefore an object of the present invention to provide a controlling method of a voltage regulator is provided. The voltage regulator at least includes a differential circuit and a pump high-voltage circuit which has a bias path, an output transistor and an output terminal. The controlling method includes steps of: providing at least a pre-charge path to the pump high-voltage circuit, closing the bias path and charging the output terminal with the pre-charge path when the output terminal is transient, detecting an output level of the output terminal, and closing the pre-charge path and open the bias path to bias the output transistor when the output level reaches a predetermined value.

According to the foregoing object of the present invention, a voltage regulator is provided. The voltage regulator includes:

- a differential circuit; and
- a pump high-voltage circuit for pumping an output of the differential circuit, comprising:
  - an output terminal having an output level;
  - an output transistor with one end electrically connected to the output terminal;
  - a bias path closed when the output terminal is transient;
  - a pre-charge path for charging the output terminal when the output terminal is transient;
  - a discharge path for discharging the output terminal when the output terminal is transient; and
  - an output level detector for detecting the output level, closing the pre-charge path or the discharge path and opening the bias path to bias the output transistor when the output level reaches a predetermined level.

According to the foregoing object of the present invention, a voltage regulator is provided. The voltage regulator includes:

- a differential circuit; and
- a pump high-voltage circuit for pumping an output of the differential circuit, comprising:
  - an output terminal having an output level;
  - an output transistor with one end electrically connected to the output terminal;
  - a bias path closed when the output terminal is transient;
  - a pre-charge path for charging the output terminal when the output terminal is transient;
  - a discharge path for discharging the output terminal when the output terminal is transient; and
  - an controller for closing the pre-charge path or the discharge path and opening the bias path to bias the output transistor according to the output level.

The foregoing and other features and advantages of the present invention will be more clearly understood through the following descriptions with reference to the drawings, wherein:

BRIEF DESCRIPTION OF THE DRAWINGS

FIG. 5 is a graph showing the output voltage of the output terminal, the voltage of the bias path, the output voltage of the output level detector, the currents of the PMOS transistors P4~P6, and the charging/discharging voltage of the capacitance load Cload according to FIG. 3.

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
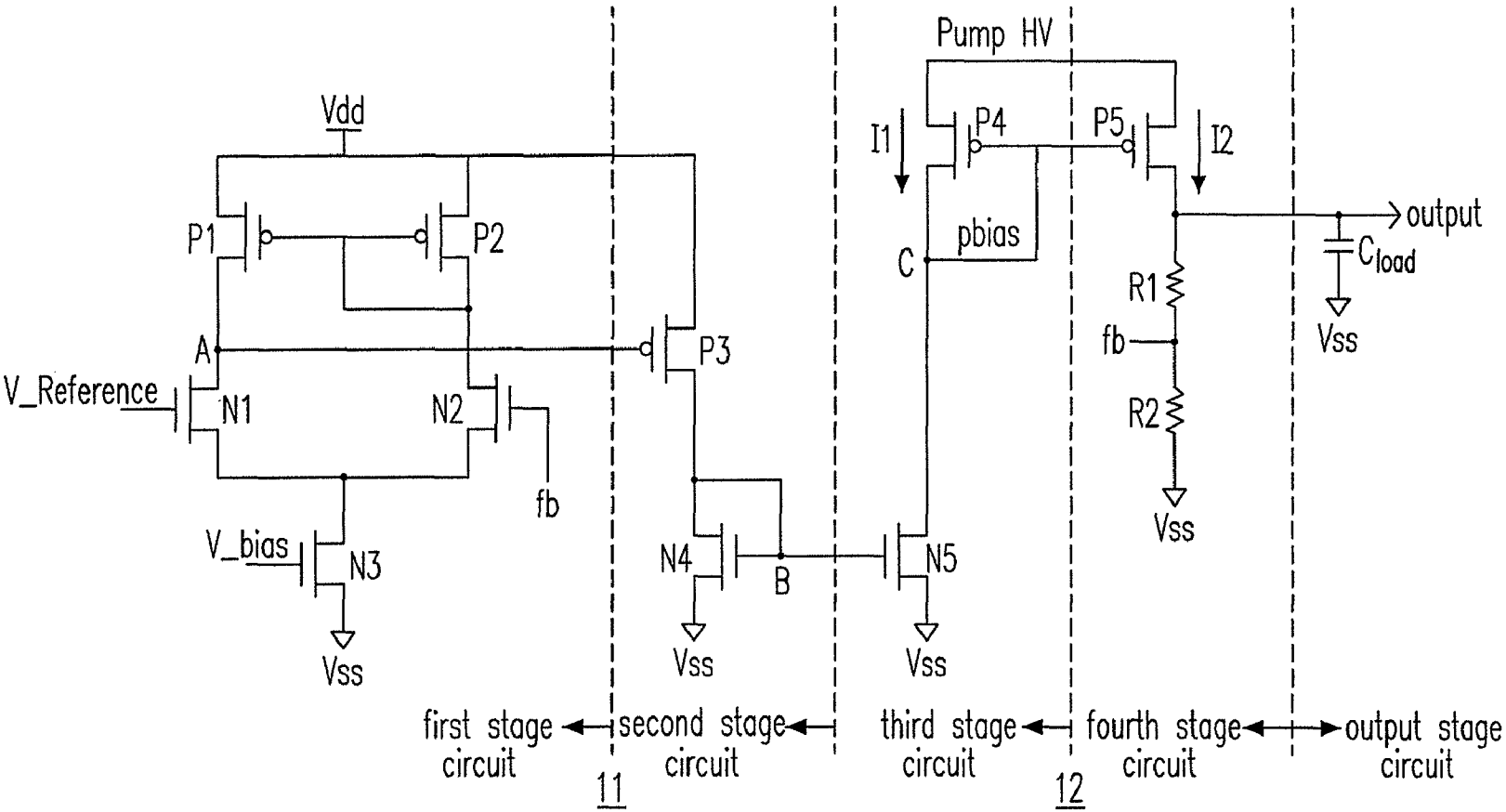
Fig. 1 PRIOR ART
FIG. 1 is a circuit diagram showing a conventional voltage regulator according to the prior art.
Figure 2:
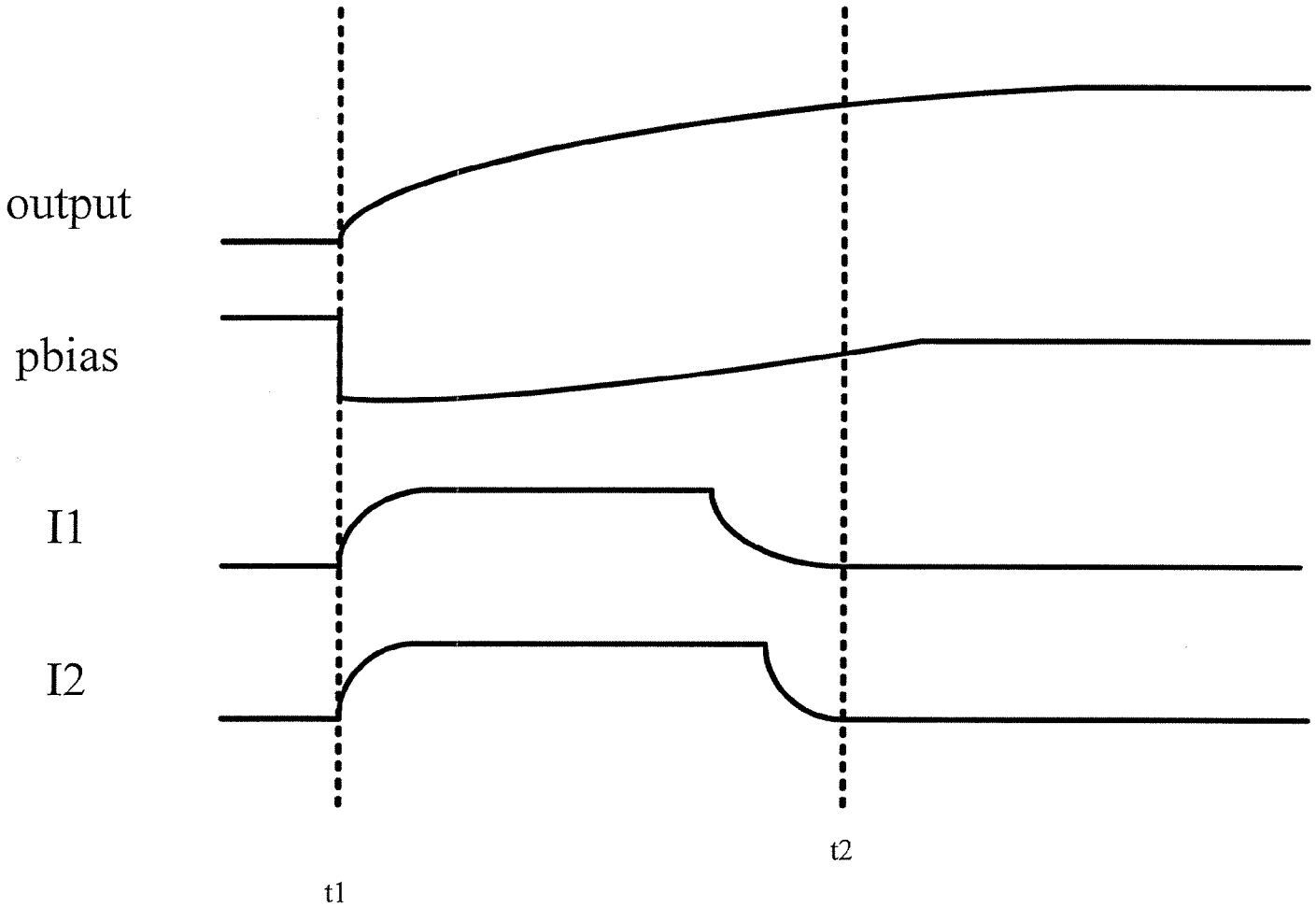
FIG. 2 is a graph showing the output terminal voltage of the voltage regulator and the currents of the PMOS transistors P4 and P5 according to FIG. 1.
Figure 3:
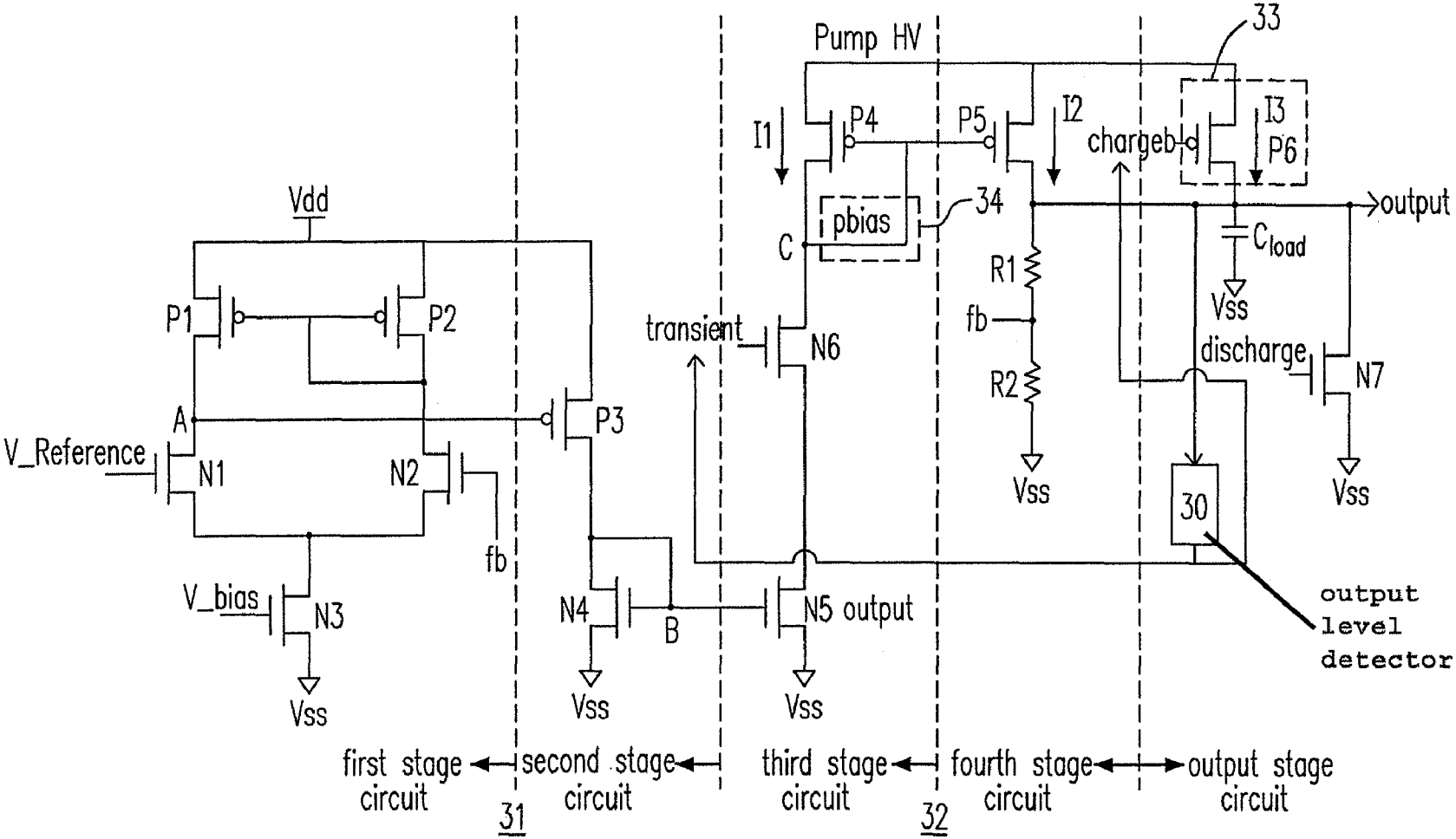
FIG. 3 is a circuit diagram showing a voltage regulator according to the first embodiment of the present invention.

Please refer to FIG. 3, which is a circuit diagram showing a voltage regulator according to the first embodiment of the present invention. In FIG. 3, the voltage regulator includes a differential circuit 31 and a pump high-voltage circuit 32. The differential circuit 31 includes a first stage circuit and a second stage circuit. The pump high-voltage circuit 32 includes a third stage circuit and a fourth stage circuit. The pump high-voltage circuit 32 is further electrically connected to an output stage circuit.

In the first stage circuit, the respective sources of the PMOS transistors P1 and P2 are electrically connected to a high voltage source Vdd. The respective gates of the PMOS transistors P1 and P2 are electrically connected to each other. The gate of the PMOS transistor P2 is electrically connected to the drain thereof. The drain of the NMOS transistor N1 is electrically connected to the drain of the PMOS transistor P1. The gate of the NMOS transistor N1 is to receive a voltage reference signal V_Reference. The drain of the NMOS transistor N2 is electrically connected to the drain of the PMOS transistor P2. The gate of the NMOS transistor N2 is to receive a feedback signal fb. The respective sources of the NMOS transistors N1 and N2 are electrically connected to the drain of the NMOS transistor N3. The gate of the NMOS transistor N3 is to receive a voltage bias signal V_bias. The source of the NMOS transistor N3 is electrically connected to a low voltage source Vss.

In the second stage circuit, the source of the PMOS transistor P3 is electrically connected to the high voltage source Vdd. The gate of the PMOS transistor P3 is electrically connected to the drain of the NMOS transistor N1. The drain of the PMOS transistor P3 is electrically connected to the drain of the NMOS transistor N4. The gate of the NMOS transistor N4 is electrically connected to the drain thereof. The source of the NMOS transistor N4 is electrically connected to the low voltage source Vss.

In the third stage circuit, the respective sources of the PMOS transistors P4 and P5 are electrically connected to a pump voltage source Pump HV. The respective gates of the PMOS transistors P4 and P5 are electrically connected to each other. The gate of the PMOS transistor P4 is electrically connected to the drain thereof to form a bias path 34. The drain of the NMOS transistor N6 is electrically connected to the drain of the PMOS transistor P4. The drain of the NMOS transistor N5 is electrically connected to the source of the NMOS transistor N6, the gate of the NMOS transistor N5 is electrically connected to the gate of the NMOS transistor N4, and the source of the NMOS transistor N5 is electrically connected to the low voltage source Vss.

In the fourth stage circuit, the drain of the PMOS transistor P5 is electrically connected to electrically series-connected resistors R1 and R2. Another end of the resistor R2 is electrically connected to the low voltage source Vss.

The output stage circuit includes a capacitance load Cload. One end of the capacitance load Cload is electrically connected to a node between the drain of the PMOS transistor P5 and the resistor R1 to be the output terminal output, and another end of the capacitance load Cload is electrically connected to the low voltage source Vss.

Besides, the output stage circuit is further electrically connected to a pre-charge path 33. In this embodiment, the pre-charge path 33 includes a PMOS transistor P6 which has a source electrically connected to the pump voltage source Pump HV and a drain electrically connected to the output terminal output.

The output stage circuit is further electrically connected to a discharge path. The output terminal output is electrically connected to the drain of the NMOS transistor N7. The gate of the NMOS transistor N7 is electrically connected to a signal discharge and the source of the NMOS transistor N7 is electrically connected to the low voltage source Vss.

Moreover, the pump high-voltage circuit 32 is further electrically connected to an output level detector 30 which has an input electrically connected to the output terminal output and an output electrically connected to the control terminal of the pre-charge path 33 and the control terminal of the NMOS transistor N6.

In order to overcome the drawback of the prior art where the currents I1 and I2 increases owing to the decreased voltage pbias, in this embodiment, the output level detector 30 is used to detect the output current level of the output terminal output. When the output level detector 30 detects the output level of the output terminal being increased to a predetermined value for the capacitance load Cload is charged, the output level detector 30 closes the bias path 34 (NMOS transistor N6) with the signal transientb and opens the pre-charge path 33 (PMOS transistor P6) with the signal chargeb. Therefore, the PMOS transistors P4 and P5 are nearly turned off. The current through the pump voltage source Pump HV constitutes the current I3 through the PMOS transistor P6.

Besides, when the output level detector 30 detects the output level of the output terminal being decreased to a predetermined value for the capacitance load Cload is discharged, the output level detector 30 closes the bias path 34 (NMOS transistor N6) with the signal transientb, opens the discharge path with the signal discharge, and closes the pre-charge path 33 (PMOS transistor P6) with the signal chargeb. The process afterward is the same with the prior art.

Figure 4:
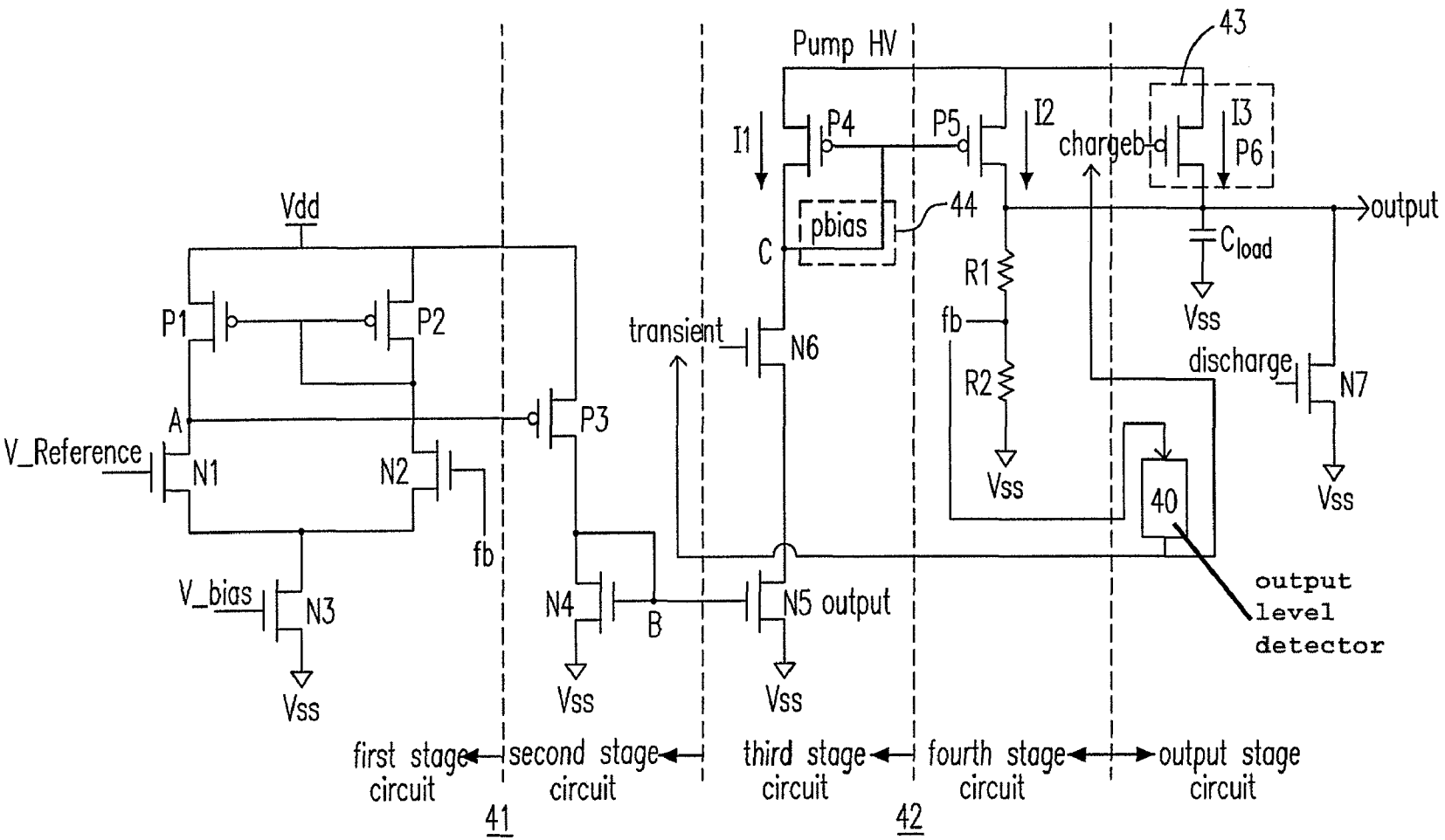
FIG. 4 is a circuit diagram showing a voltage regulator according to the second embodiment of the present invention.

Please refer to FIG. 4, which is a circuit diagram showing a voltage regulator according to the second embodiment of the present invention. The difference between FIGS. 3 and 4 is the input of the output level detector 40 is changed to be electrically connected to the node between the series-connected resistors R1 and R2, so as to detect the output voltage level of the output terminal output. The rest of the implementation is the same with the prior embodiment.

Except for the above two embodiments, a controller (now shown in the Figs) can also be used to replace the output level detector. A predetermined program is integrated in the controller to automatically open the bias path and close the pre-charge path if necessary. Being not as smart as the above two embodiment, the controller is still easily achieved by one skilled in the art.

Please refer to FIG. 5, which is a graph showing the output voltage of the output terminal, the voltage of the bias path, the output voltage of the output level detector, the currents of the PMOS transistors P4~P6, and the charging/discharging voltage of the capacitance load Cload according to FIG. 3.

When the capacitance load Cload is about to be charged at time t1, the charging voltage charge is low and the level of the output terminal output is also about to be raised to a high level. The output level detector closes the bias path and opens the pre-charge path, so that the levels of the currents I1 and I2 are low and the level of the current I3 is high. At this time, the voltage pbias of the node C is high, and the output levels transient and chargeb of the output level detector are both low.

When the capacitance load Cload is about to be discharged at time t2, the charging voltage charge is high and the level of the output terminal output is also about to be decreased to a low level. The output level detector closes the bias path and opens the discharge path, so that the levels of the currents I1 and I2 are low. At this time, the voltage pbias of the node C is high, the output levels discharge and chargeb of the output level detector are both high, and the signal transient is low.

In conclusion, with the voltage regulator and controlling method provided in the invention, the power of the voltage regulator can be decreased, the output current of the pump high-voltage circuit can be reduced, and the layout size of the pump high-voltage circuit can be minimized.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A controlling method of a voltage regulator, the voltage regulator at least comprising a differential circuit and a pump high-voltage circuit which has a bias path, an output transistor and an output terminal, comprising steps of:

(a) providing at least a pre-charge path and a discharge path to the pump high-voltage circuit;

(b) closing the bias path and charging the output terminal with the pre-charge path if a transient of a voltage of the output terminal is raised, and discharging the output terminal with the discharge path if the transient of the voltage of the output terminal is decreased;

(c) detecting an output level of the output terminal; and (d) closing the pre-charge path and the discharge path and opening the bias path to bias the output transistor when the output level reaches a predetermined value.

2. The controlling method as claimed in claim 1, wherein the step (a) further comprises: coupling a first transistor to the output transistor so as to form the pre-charge path and coupling a third transistor to the output transistor so as to form the discharge path.

3. The controlling method as claimed in claim 1, wherein the step (b) further comprises: coupling a second transistor to the bias path so as to close the bias path.

4. The controlling method as claimed in claim 1, wherein the step (c) further comprises: detecting one of an output current level and an output voltage level of the output terminal.

5. A voltage regulator, comprising:

a differential circuit; and a pump high-voltage circuit for pumping an output of the differential circuit, comprising:

an output terminal having an output level;

an output transistor with one end electrically connected to the output terminal;

a bias path closed when the output terminal is transient;

a pre-charge path for charging the output terminal when a transient of a voltage of the output terminal is raised;

a discharge path for discharging the output terminal when the transient of the voltage of the output terminal is decreased; and an output level detector for detecting the output level, closing the pre-charge path and opening the bias path to bias the output transistor when the output level reaches a predetermined level.

6. The voltage regulator as claimed in claim 5, wherein the differential circuit comprises:

a first stage circuit, comprising:

a first PMOS transistor having a source electrically connected to a high voltage source;

a second PMOS transistor having a source electrically connected to the high voltage source, and a gate electrically connected to a gate of the first PMOS transistor;

a first NMOS transistor having a drain electrically connected to a drain of the first PMOS transistor;

a second NMOS transistor having a drain electrically connected to a drain of the second PMOS transistor; and a third NMOS transistor having a drain electrically connected to a source of the first NMOS transistor and a source of the second NMOS transistor, and a source electrically connected to a low voltage source; and a second stage circuit, comprising:

a third PMOS transistor having a source electrically connected to the high voltage source, and a gate electrically connected to a drain of the first PMOS transistor; and a fourth NMOS transistor having a drain electrically connected to a gate thereof and a drain of the third PMOS transistor, a source electrically connected to the low voltage source, and a gate as an output of the differential circuit.

7. The voltage regulator as claimed in claim 6, wherein the low voltage source is grounded.

8. The voltage regulator as claimed in claim 5, wherein the pump high-voltage circuit comprises:

a third stage circuit, comprising:

a fourth PMOS transistor having a source electrically connected to a pump voltage source, and a gate electrically connected to a drain thereof to form the bias path;

a sixth NMOS transistor having a drain electrically connected to a drain of the fourth PMOS transistor; and a fifth NMOS transistor having a drain electrically connected to a source of the sixth NMOS transistor, a gate electrically connected to the output of the differential circuit, and a source electrically connected to low voltage source; and a fourth stage circuit, comprising:

a fifth PMOS transistor having a source electrically connected to the pump voltage source, a gate electrically connected to a gate of the fourth PMOS transistor, and a drain as the output terminal.

9. The voltage regulator as claimed in claim 8, wherein the low voltage source is grounded.

10. The voltage regulator as claimed in claim 5, wherein the pump high-voltage circuit is further electrically connected to a output stage circuit comprising:

a sixth PMOS transistor as the output transistor to form the pre-charge path, having a source electrically connected to the pump voltage source; and a seventh NMOS transistor as the output transistor to form the discharge path, having a source electrically connected to a low voltage source so as to form the output terminal.

11. The voltage regulator as claimed in claim 5, wherein the output level detector comprises:

an input electrically connected to the output terminal for detecting an output current of the output terminal; and three outputs electrically connected to the bias path, the discharge path and the pre-charge path for controlling the bias path and the pre-charge path.

12. The voltage regulator as claimed in claim 5, wherein the output terminal is further electrically connected to a first resistor and a second resistor electrically series-connected thereto, the output level detector comprising:

an input electrically connected to a node between the first resistor and the second resistor for detecting an output voltage of the output terminal; and an output electrically connected to the bias path and the pre-charge path for controlling the bias path and the pre-charge path.

13. A voltage regulator, comprising:

a differential circuit; and a pump high-voltage circuit for pumping an output of the differential circuit, comprising:

an output terminal having an output level;

an output transistor with one end electrically connected to the output terminal;

a bias path closed when the output terminal is transient;

a pre-charge path for charging the output terminal when a transient of a voltage of the output terminal is raised;

a discharge path for discharging the output terminal when the transient of the voltage of the output terminal is decreased; and a controller for closing the pre-charge path and opening the bias path to bias the output transistor according to the output level.

14. The voltage regulator as claimed in claim 13, wherein the differential circuit comprises:

a first stage circuit, comprising:

a first PMOS transistor having a source electrically connected to a high voltage source;

a second PMOS transistor having a source electrically connected to the high voltage source, and a gate electrically connected to a gate of the first PMOS transistor;

a first NMOS transistor having a drain electrically connected to a drain of the first PMOS transistor;

a second NMOS transistor having a drain electrically connected to a drain of the second PMOS transistor; and a third NMOS transistor having a drain electrically connected to a source of the first NMOS transistor and a source of the second NMOS transistor, and a source electrically connected to a low voltage source; and a second stage circuit, comprising:

a third PMOS transistor having a source electrically connected to the high voltage source, and a gate electrically connected to a drain of the first PMOS transistor; and a fourth NMOS transistor having a drain electrically connected to a gate thereof and a drain of the third PMOS transistor, a source electrically connected to the low voltage source, and a gate as an output of the differential circuit.

15. The voltage regulator as claimed in claim 14, wherein the low voltage source is grounded.

16. The voltage regulator as claimed in claim 13, wherein the pump high-voltage circuit comprises:

a third stage circuit, comprising:

a fourth PMOS transistor having a source electrically connected to a pump voltage source, and a gate electrically connected to a drain thereof to form the bias path;

a sixth NMOS transistor having a drain electrically connected to a drain of the fourth PMOS transistor; and a fifth NMOS transistor having a drain electrically connected to a source of the sixth NMOS transistor, a gate electrically connected to the output of the differential circuit, and a source electrically connected to low voltage source; and a fourth stage circuit, comprising:

a fifth PMOS transistor having a source electrically connected to the pump voltage source, a gate electrically connected to a gate of the fourth PMOS transistor, and a drain as the output terminal.

17. The voltage regulator as claimed in claim 16, wherein the low voltage source is grounded.

18. The voltage regulator as claimed in claim 13, wherein the pump high-voltage circuit is further electrically connected to a output stage circuit comprising:

a sixth PMOS transistor as the output transistor to form the pre-charge path, having a source electrically connected to the pump voltage source; and a seventh NMOS transistor as the output transistor to form the discharge path, having a source electrically connected to a low voltage source so as to form the output terminal.

19. The voltage regulator as claimed in claim 13, wherein the controller comprises:

an input electrically connected to the output terminal; and an output electrically connected to the bias path, the discharge path and the pre-charge path.

* * * * *